US006631815B1

(12) United States Patent
Laenge

(10) Patent No.: US 6,631,815 B1
(45) Date of Patent: Oct. 14, 2003

(54) TURNTABLE OF A ROTARY CRANE

(75) Inventor: Walter Laenge, Ludesch (AT)

(73) Assignee: Liebherr-Werk Nenzing GmbH, Nenzing (AT)

( * ) Notice: Subject to any disclaimer, the term of this patent is extended or adjusted under 35 U.S.C. 154(b) by 0 days.

(21) Appl. No.: 09/855,259

(22) Filed: May 15, 2001

(51) Int. Cl.[7] ..... B66C 23/84
(52) U.S. Cl. ..... 212/253
(58) Field of Search ..... 212/175, 179, 212/253, 270

(56) References Cited

U.S. PATENT DOCUMENTS 2,754,012 A * 7/1956 Hines ..... 212/179
4,061,230 A * 12/1977 Goss et al. ..... 212/253
4,184,600 A * 1/1980 Goss et al. ..... 212/253
4,216,870 A * 8/1980 Bonneson et al. ..... 212/253
4,354,606 A * 10/1982 Morrow et al. ..... 212/175
4,513,869 A * 4/1985 Goudy ..... 212/175
5,310,067 A 5/1994 Morrow
5,328,040 A 7/1994 Morrow

* cited by examiner

*Primary Examiner*—Thomas J. Brahan
(74) *Attorney, Agent, or Firm*—Dilworth & Barrese, Esq.

(57) ABSTRACT

The present invention concerns a turntable of a rotary crane of the king post type having a pylon anchored to a base plate, platform, or similar base. The turntable has a support frame that can slide above and is suspended from the pylon, coupling devices connected to the support frame to permit the coupling of a crane boom, and support devices to allow the support frame to revolve around the longitudinal axis of the pylon. The support devices have an upper support for the suspension of the support frame on an upper end section of the pylon, and a lower support for the suspension of the support frame on a lower section of the pylon, with the lower support having a bearing journal that encircles the pylon. According to the invention, the bearing journal of the lower support is designed to be divided. The support frame has an open longitudinal side through which the support frame with divided bearing journal can slide radially along the pylon.

20 Claims, 7 Drawing Sheets

TURNTABLE OF A ROTARY CRANE

BACKGROUND OF THE INVENTION

The present invention concerns a turntable of a rotary crane of the king post type having a pylon anchored to a base plate, platform, or similar base, with a support frame mounted on bearings above and suspended from the pylon, coupling devices connected to the support frame to permit the coupling of a crane boom, and support devices to allow the support frame to revolve on the longitudinal axis of the pylon, the support devices having an upper support for the suspension of the support frame on an upper end section of the pylon and a lower support for the suspension of the support frame on a lower section of the pylon, and the lower support has a bearing journal that surrounds the pylon.

Rotary cranes of the king post type are known, for example, from U.S. Pat. No. 5,328,040 or U.S. Pat. No. 5,310,067. The turntable of such cranes is mounted on a bell-like mounting on, and is mounted to revolve around, the upper end of the pylon by means of a radial and an axial support and at its lower end by means of an axial support, so that the entire turntable can be revolved on the longitudinal axis of the pylon. Rotary cranes of this type are used especially as offshore cranes on oil rigs, ships and the like. In rotary cranes of this type, erection is particularly problematic, especially because of their size but also because of the harsh environment, such as high seas, strong winds, and similar conditions. Because of the radial support, it is difficult to position the turntable above the pylon. The turntable of the rotary crane according to U.S. Pat. No. 5,328,040 or U.S. Pat. No. 5,310,067 must be raised above the pylon, which is quite high, and must be lined up axially and positioned on the pylon from above, a time-consuming and difficult procedure.

The problem to be solved by the present invention is to create an improved rotary crane that avoids the disadvantages of and constitutes an advantageous further development of the stat e of the art. Especially, the turntable of the crane is to be improved in such manner as to permit easier assembly of the crane.

SUMMARY OF THE INVENTION

According to the invention, this problem is solved by means of a turntable of a rotary crane of the king post type having a pylon anchored to a base plate, platform, or similar base, with a support frame that can be slid above and suspended from the pylon, coupling devices connected to the support frame to permit the coupling of a crane boom, and support devices to allow the support the support frame to revolve on the longitudinal axis of the pylon, the support devices having an upper support for the suspension of the support frame on an upper end section of the pylon and a lower support for the suspension of the support frame on a lower section of the pylon, with the lower support having a bearing journal that encircles the pylon, characterized by the fact that the bearing journal of the lower support is designed to be divided and the support frame has an open longitudinal side through which the support frame with divided bearing journal can slide radially on the pylon.

Preferred embodiments of the invention are described herein.

The turntable is characterized by the fact that the bearing journal of the lower support is divisible, and the support frame of the turntable has an open longitudinal side through which the support frame with divided bearing journal can be slid radially to the pylon. According to the invention, it is therefore not necessary to position the turntable from above and longitudinally in line with the platform. Rather, the turntable is to be positioned transversely, that is, horizontally above the vertical pylon. This allows recessing of the support frame on the sleeve surface side, which recess is at least as large as the profile of the pylon. The narrow width of the opening of the support frame on its longitudinal side is at least the size of the diameter of the pylon. The turntable needs to be raised only high enough to permit it to be slid over the upper support and suspended there.

In a further development of the invention, the support frame consists of two facing side pedestals, connected along one longitudinal side by means of joined cross-braces, and unconnected along a second side, opposite the first side. The unconnected side forms the top-side recess through which the support frame can be lifted onto the pylon from the side. The support frame is thus a framework structure, not a cylindrical sleeve. The side longitudinal braces or side pillars can be designed in various ways. According to one embodiment of the invention they have a rectangular section. The framework-type cross-bracing on one longitudinal side considerably increases the resistance to torsion by the support frame.

At one end, which forms the upper end of the crane when assembled, the two side pillars can be connected preferably by a common head piece, on which deflection sheaves for deflecting a cable of the crane can be positioned. On the opposite end, which, when the crane is assembled, forms the lower end of the support frame, the two side pillars are connected by the bearing journal of the lower support. Especially, one half of the divisible bearing journal can be permanently connected to the two pillars. The detachable portion of the bearing journal can be installed on the lower ends of the side pillars.

The bearing journal of the lower support is divided approximately in half, so that when the removable half is removed the bearing journal segment remaining on the support frame can be slid in a radial direction along the pylon. Advantageously the division plane of the bearing journal is perpendicular to the longitudinal center plane of the turntable, which is defined on the one hand by the longitudinal axis of the pylon and on the other hand by the crane boom connected to the turntable.

Theoretically the bearing journal can be divided into a number of segments. According to one advantageous embodiment of the invention, the bearing journal is constructed in two parts. One half of the bearing journal is constructed in one piece integrated with the support frame. The other half of the bearing journal can have front flange plates that can be bolted to the side pillars of the support frame.

In a further development of the invention, the open longitudinal side of the support frame is positioned on the back of the turntable; that is, the support frame side facing the crane boom is open. The detachable half of the bearing journal of the lower support is accordingly the roller-race half that faces the crane boom. The front side, i.e. the boom side of the bearing journal, is connected permanently and non-detachably to the turntable. This prevents the front section from falling out when the flange connection is opened or breaks. The operator's cabin, which preferably is connected to the front section of the support ring, is also protected from falling out. This considerably increases safety.

The upper support of the turntable is appropriately constructed as a radial support and an axial support. The lower support can be constructed as a purely radial support.

In contrast to the lower support, the upper support need not be divisible, it can be in one piece. Specifically, the upper support is designed in such manner that it can be installed from the upper end of the pylon on the upper support or on a support piece on the upper end of the pylon. This can considerably facilitate the installation of the turntable on the pylon. Initially the turntable is positioned transversely to the pylon and suspended by its upper end or its upper support on the upper end section of the pylon. Then the lower section of the turntable with its lower support can be swiveled transversely onto the pylon.

To simplify the positioning of the turntable on the pylon in the area of the lower bearing journal, the lower support can have a number of support shoes connected detachably to the bearing journal, so that they can be removed from the bearing journal for the erection of the turntable. Specifically, the support shoes can rest on the inner perimeter surface of the bearing journal and can be connected to said bearing journal in such manner that they can be positioned axially to, that is, parallel to, the longitudinal direction of the pylon between the bearing journal and the pylon, in such manner that they can positioned or removed from the bearing journal. The fact that the support shoes can be mounted parallel to the longitudinal axis of the pylon allows the support shoes to be positioned even subsequently, that is, when the bearing journal is already on the pylon, between the internal perimeter surface of the bearing journal and the external perimeter surface of the pylon. To permit this, provision can theoretically be made for the support shoes to grasp the bearing journal only from the front. Preferably, however, the support shoes have a back that rests flat on the internal perimeter surface of the bearing journal, and flange bridges standing away from the back at right ankles, with which the support shoes grip the bearing journal on both sides. To permit such axial installation, the flange bridges on one axial side can be detachable from the support shoes. The two-sided gripping of the bearing journal permits a non-tipping, solid attachment of the support shoes. Accordingly, after the flange bridge is removed, the support shoes can be pushed to one side axially between the bearing journal and the pylon.

Rotating gear drives for rotating the turntable on the pylon are appropriately mounted on the support frame. Specifically, they can be positioned on that portion of the lower bearing journal that is permanently connected to the support frame side pillars.

BRIEF DESCRIPTION OF THE DRAWINGS

The invention is explained below in greater detail with the help of a preferred embodiment and pertinent drawings showing.

DESCRIPTION OF THE PREFERRED EMBODIMENTS

Figure 1:
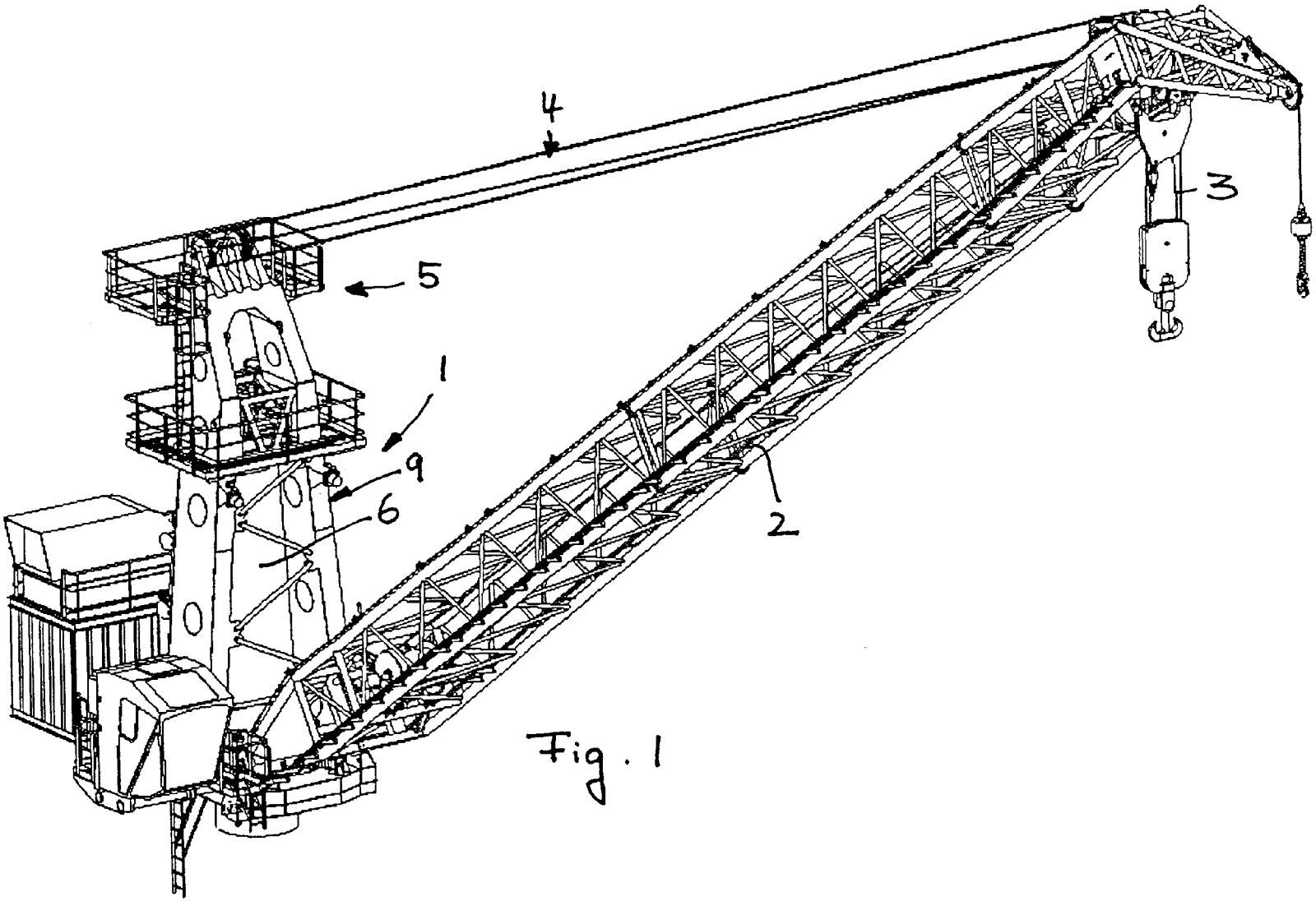
FIG. 1: A perspective view of an offshore crane of the king post type, having a turntable positioned on a pylon, on which turntable a boom that can move up and down on a horizontal axis is attached.

The king-post offshore crane shown in FIG. 1 has a turntable 1 mounted in such manner that it can revolve on a vertical axis, on which turntable 1 a crane boom 2 is coupled to move up and down on a horizontal axis. Above the projecting end of crane boom 2 there is a lifting cable 3 to which a crane hook can be attached. Crane boom 2 is supported on a support cable 4 that is guided over a peak section 5 of turntable 1.

Turntable 1 is mounted on a pylon 6 that extends vertically on its longitudinal axis and is rigidly anchored to a supporting sub-structure, e.g. a base plate, a platform, or similar base. Turntable 1 is held to the pylon by means of an upper support 7 on the upper end of pylon 6, as well as a lower support 8 at the foot of pylon 6, so that it can revolve on the pylon. While lower support 8 may be a purely radial support, upper support 7 preferably has both a radial support and an axial support that supports turntable 1 in the longitudinal direction of pylon 6 as well.

Figure 2:
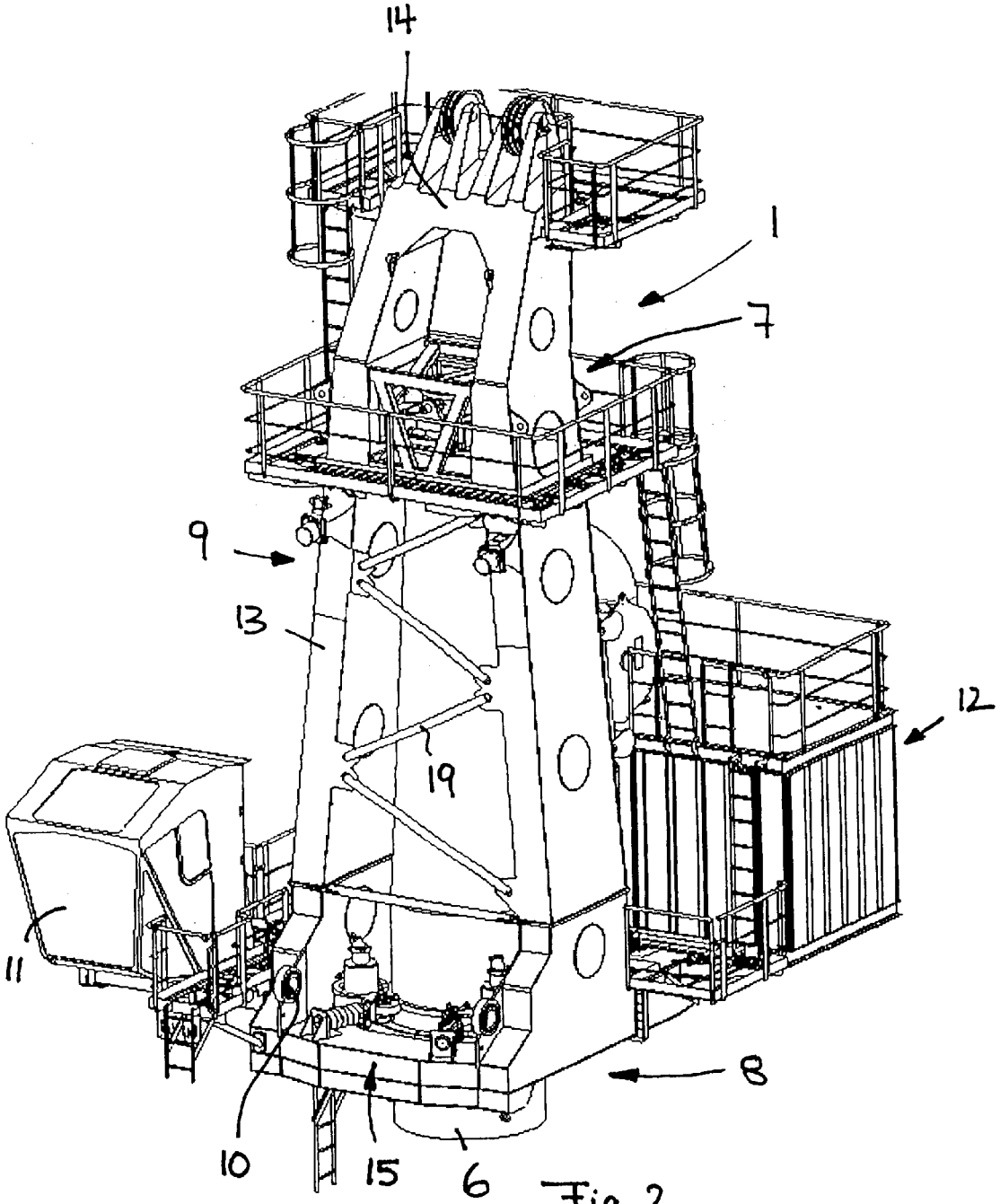
FIG. 2: A perspective view of the turntable of FIG. 1, on which the boom has been removed and the turntable is shown from the boom side.
Figure 3:
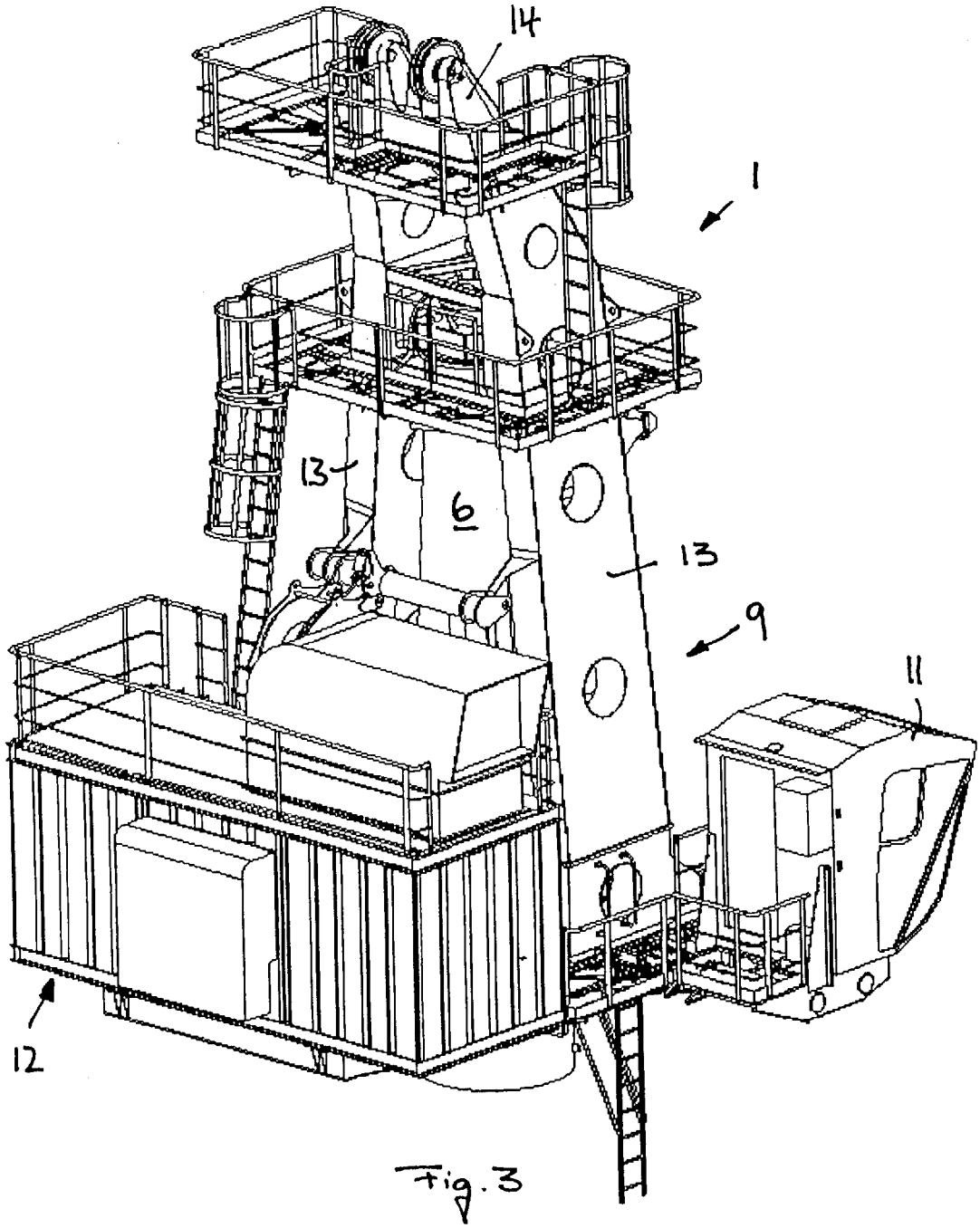
FIG. 3: A perspective view of the turntable of FIG. 2, showing the turntable from the back facing away from the boom.

As shown in FIG. 2, turntable 1 has a support frame 9 that rests like a bell on pylon 6. Various structures are positioned on support frame 9 in addition to coupling devices 10 for boom 2. These structures can include an operators cab 11 as well as rear machine structures 12 such as cable drums, counterweights, drive units, etc.

Figure 4:
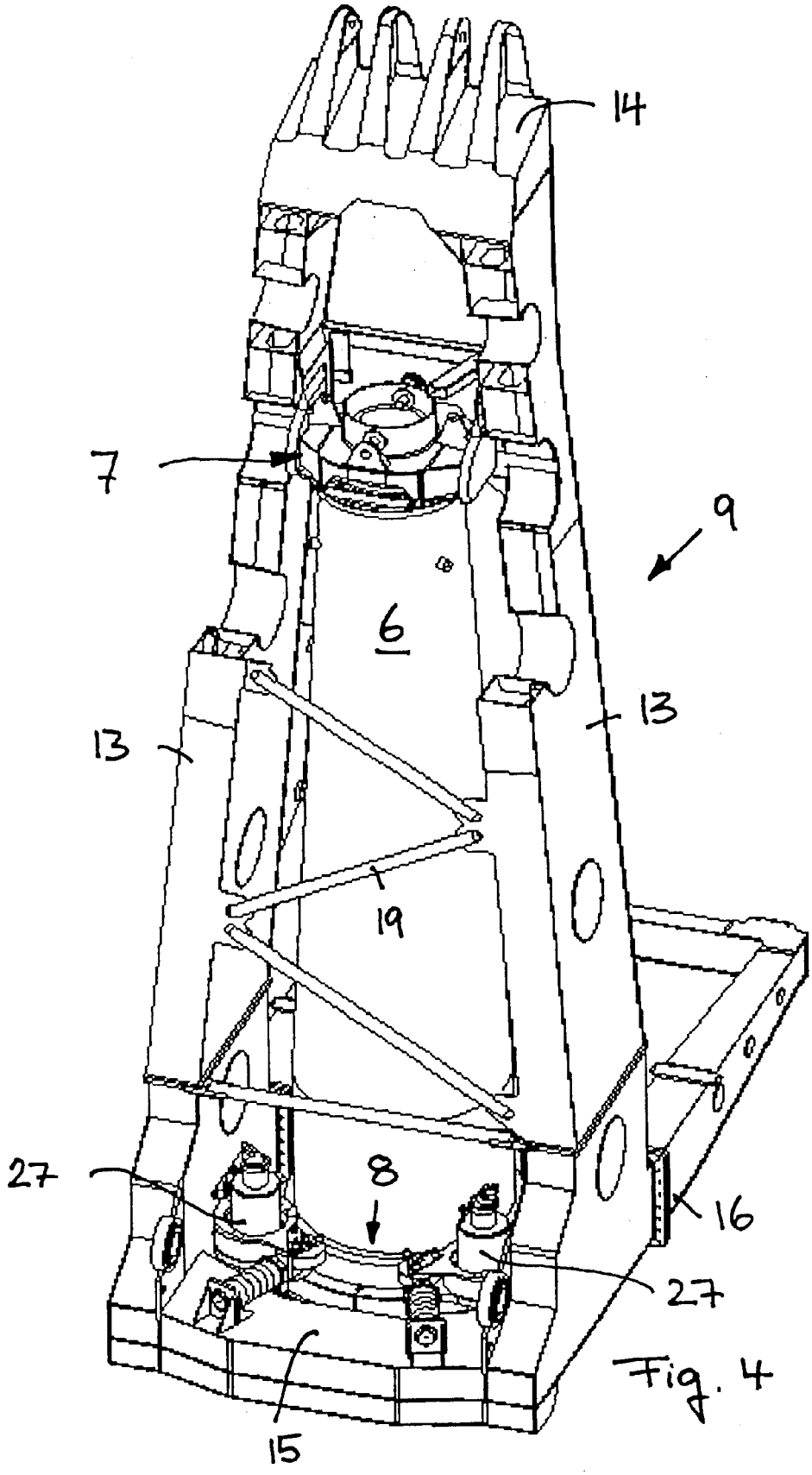
FIG. 4: A perspective view of the support frame of the turntable, with the turntable resting on the pylon and able to revolve.

Support frame 9 consists of two longitudinal or side pillars 13 separated by a space, essentially vertical, slightly V-shaped (cf. FIG. 2 and FIG. 4). The two side pillars 13 are connected at the upper end by a yoke-like common head piece 14. Deflection sheaves are provided on head piece 14 for wire cable 4.

At its lower end, support frame 9 is connected by means of a bearing journal 15 that forms lower support 8 of turntable 1 relative to pylon 6. More precisely, the two side pillars 13 are connected only by one half of bearing journal 15, since bearing journal 15 is divided (cf. FIG. 5). A back half 16 of bearing journal 15, which faces away from crane boom 2, can be removed from support frame 9. It has two front flange plates 17 with which it can be permanently bolted at the lower end of support frame 9 to side surfaces thereof. There are complementary flange plates 18 on support frame 9 (cf. FIG. 5).

Figure 5:
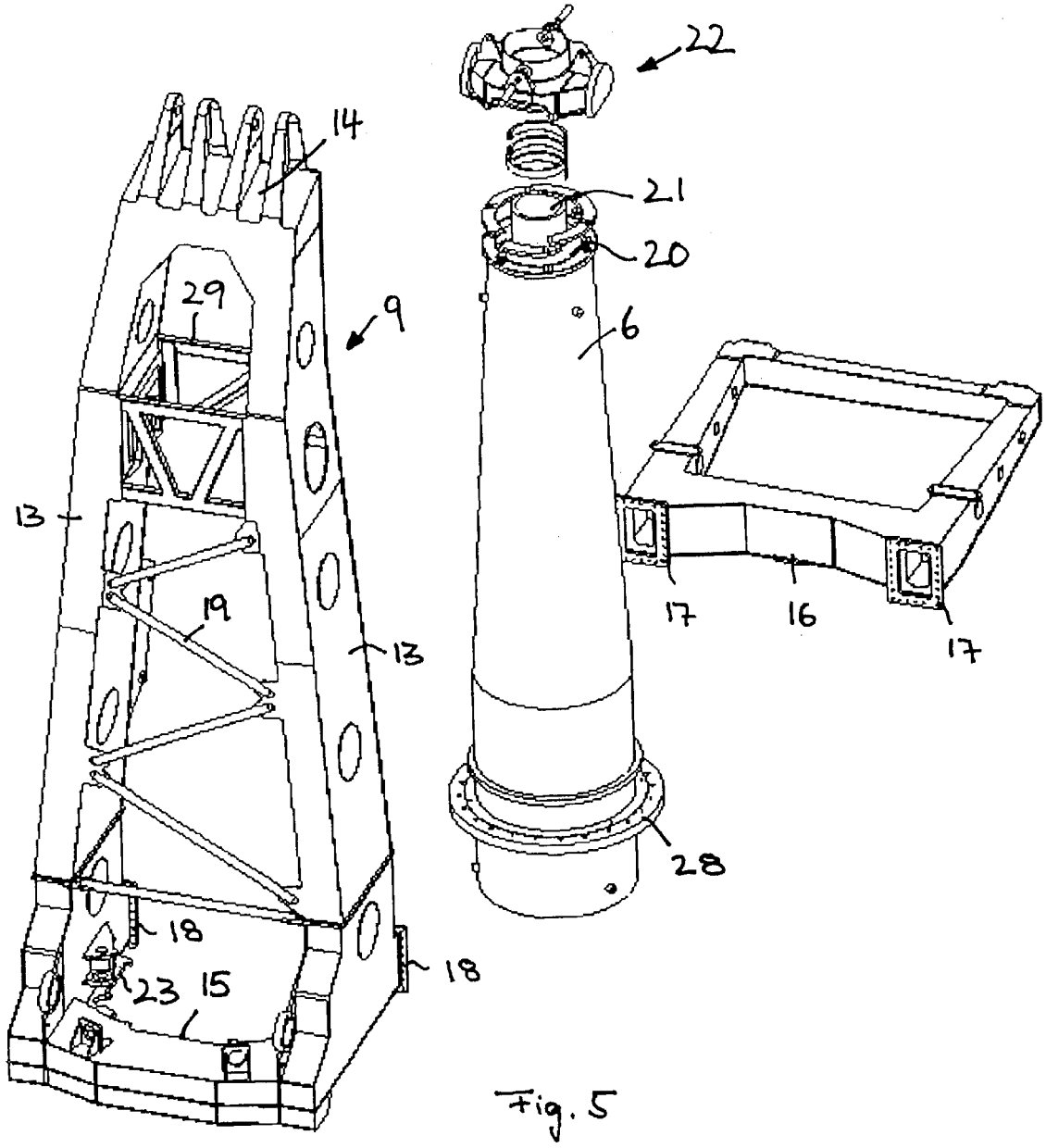
FIG. 5: A perspective exploded view showing the support frame of the turntable, the pylon, the upper support between the support frame and the pylon, and the lower bearing journal for suspending the support frame to the pylon when divided.

As shown in FIG. 5, side pillars 13 are joined on their longitudinal side facing boom 2 by means of several cross-braces 19. These cross-braces 19, however, are located only on the front of support frame 9. The back, that is, the support frame 9 side facing away from boom 2, is open; here, the two side pillars 13 are not connected. The two side pillars 13 are connected at the back only at or above upper support 7. The area below the lower support is open at the back when the bearing journal is unbolted. As shown in FIG. 5, cross-bracing 29 is provided on the back of support frame 9 only in the area of upper support 7 or above it.

As shown in FIG. 5, at its upper end pylon 6 has an essentially flat front 20 and a support pin 21 projecting longitudinally toward pylon 6. On support pin 21 there is a bushing 22 supported radially on support pin 21 and axially on front surface 20. Bushing 22 is designed in such manner that support frame 9 can be suspended on it from the top. In support frame 9, or more precisely in the two side pillars 13, there are appropriate support recesses for the positioning of support frame 9 on bushing 22.

Figure 6:
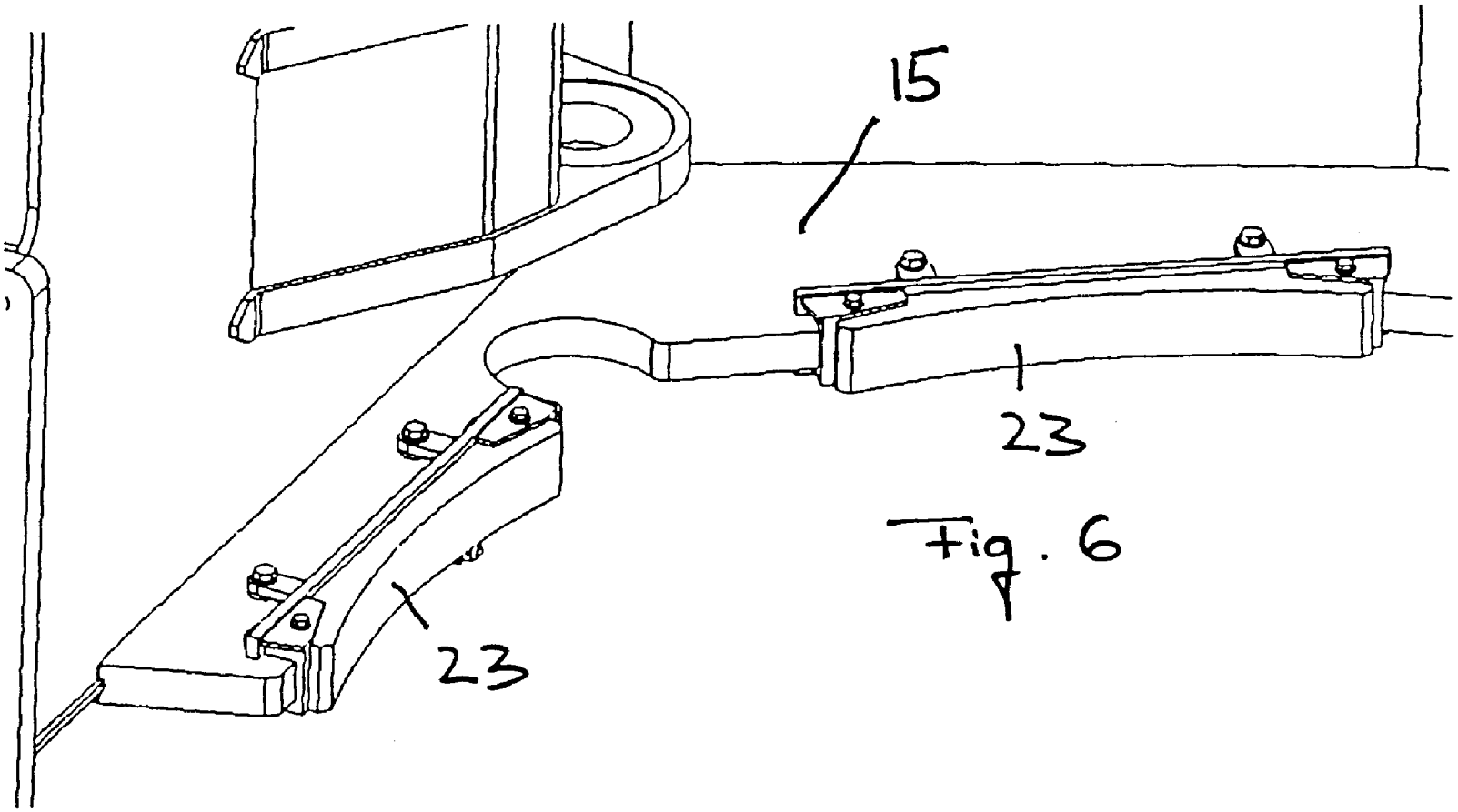
FIG. 6: A perspective view of support shoes mounted on the lower bearing journal of the support frame.
Figure 7:
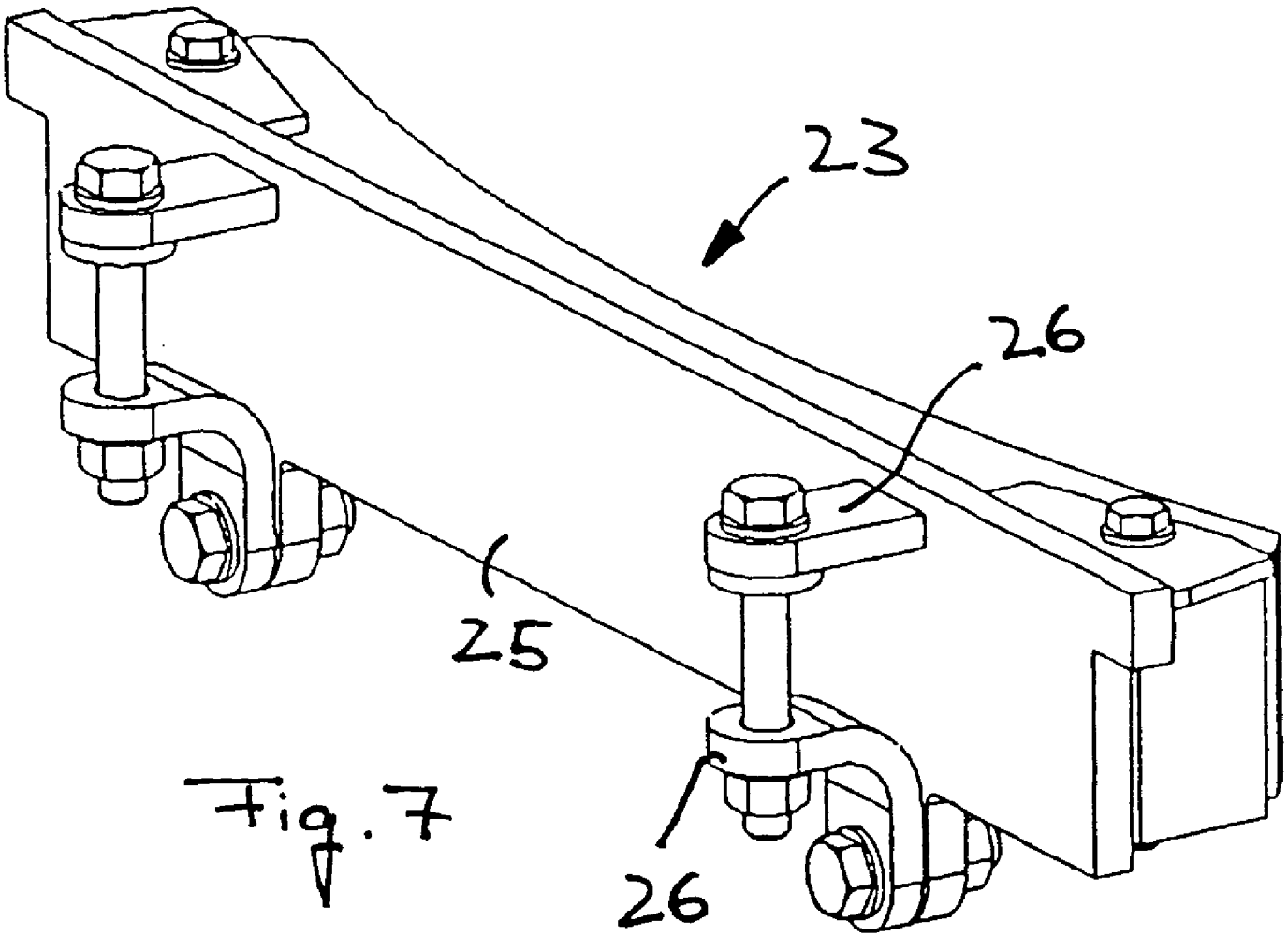
FIG. 7: A perspective view of a support shoe according to FIG. 6.

The lower support 8 has support shoes 23 resting on bearing journal 15 (cf. FIG. 6) that have semi-circular facings. Support shoes 23 have a flat steel plate with which they are supported flat on the inner perimeter surface of bearing ring 15. Essentially rectangular retaining lugs 26 (cf. FIG. 7) project from the flat back of steel plates 25. Said retaining lugs 26 grip support shoes 23 on both side of bearing journal 15. Bolts are inserted through attachment lugs 26 and can then be drawn through bearing ring 15. As shown in FIG. 7, the lower attachment lugs 26 of support shoes 23 can be removed from steel plate 25. They are formed by elbows bolted to an axially overhanging attachment eye of steel plate 25. Because two of the attachment lugs 26 are removable, despite the two-sided gripping of bearing ring 15, the support shoe can subsequently be attached to it, when support frame 9 is already resting on the pylon 6. Specifically, the support shoes 23 can be pushed through axially, that is, parallel to the longitudinal direction of the pylon between pylon 6 and bearing journal 15. This considerably simplifies the erection of support frame 9 on pylon 6. This can be achieved as follows:

Support frame 9 moves horizontally on the vertical, permanently anchored pylon 6, with its open back to the pylon. Support frame 9 need not be guided from above onto the pylon 6, support frame 9 is guided transversely to its mounted position only slightly raised above pylon 6. It is raised only far enough that the upper support positions of support frame 9 can pass over the support on the pylon side. Support frame 9 can with its upper end be slightly inclined above the pylon 6, so that the support-frame-side and pylon-side support positions of upper support 7 line up. The support frame is slightly lowered, the support frame 9 is initially suspended on upper support 7. The lower end section of support frame 9 can then be guided radially onto pylon 6, so that bearing journal 15 or the half permanently connected to side pillars 13 is positioned on the pylon perimeter. The support shoes 23 on the side, that is, in the area of the side pillars and the joint between the bearing journal halves are at this time still disabled, in order to facilitate the guiding of support frame. 9 onto pylon 6. The back half 16 of bearing journal 15 is then mounted on support frame 9. Lastly, the still disabled support shoes 23 are pushed from above between pylon 6 and bearing journal 15 and are bolted by means of the bolts shown in FIG. 7. Prior to this, the lower attachment lugs 26 in the form of the elbow are bolted to support shoes 23.

Support frame 9 can rotate on pylon 6 by means of rotary drives 27 mounted on the half of bearing journal 15 that faces the crane boom 2 (cf. FIG. 4). Rotary drives 27 mesh with a gear ring 28 that surrounds pylon 6 (cf. FIG. 5).

I claim:

1. Turntable for a king post rotary crane having a central column or pylon structured and arrange to be anchored to a base and on which the entire crane is suspended on an upper end of the column or pylon and supported on a lower end of the column or pylon, comprising a support frame structured and arranged to be slid on and suspended from the pylon, coupling devices connected to the support frame and structured and arranged to couple a crane boom thereto, support devices structured and arranged to allow the support frame to revolve on a longitudinal axis of the pylon, said support devices having an upper support for the suspension of the support frame on an upper end section of the pylon and a lower support for the suspension of the support frame on a lower section of the pylon, and said lower support having a bearing journal structured and arranged to at least partially encircle the pylon, wherein said bearing journal of said lower support is divided, said support frame has an open longitudinal side by which said support frame, with said divided bearing journal, is structured and arranged to slide radially on the pylon, said support frame comprises two side pillars facing each other and joined together along a first longitudinal side of said support frame, said pillars not being joined together on a side opposite to the first longitudinal side of said support frame, and said turntable is structured and arranged to be rotatably secured to the pylon by transversely moving into engagement with the pylon.

2. Turntable according to claim 1, wherein, cross braces are structured and arranged to join said side pillars together along said first longitudinal side of said support frame.

3. Turntable according to claim 2, additionally comprising a common head piece structured and arranged to join said two side pillars at one end thereof, with said bearing journal of the lower support structured and arranged to join said two side pillars at a second opposite end to said common head piece.

4. Turntable according to claim 3, wherein one half of the bearing journal comprises front flange plates structured and arranged to be bolted to said side pillars of said support frame.

5. Turntable according to claim 4, wherein said bearing journal of the lower support is divided approximately at a middle into a plane substantially coextensive with a plane defined through a longitudinal axis of the pylon when said bearing journal is mounted upon the pylon.

6. Turntable according to claim 3, wherein said bearing journal of the lower support is divided approximately at a middle into a plane substantially coextensive with a plane defined through a longitudinal axis of the pylon when said bearing journal is mounted upon the pylon.

7. Turntable according to claim 2, wherein one half of the bearing journal comprises front flange plates structured and arranged to be bolted to said side pillars of said support frame.

8. Turntable according to claim 1, wherein said open longitudinal side of said support frame faces away from a side of said support frame to which the coupling devices for the crane boom are connected.

9. Turntable according to claim 8, wherein one half of the bearing journal comprises front flange plates structured and arranged to be bolted to said side pillars of said support frame.

10. Turntable according to claim 1, wherein said bearing journal of the lower support is divided approximately at a middle into a plane substantially co-extensive with a plane defined through a longitudinal axis of the pylon when said bearing journal is mounted upon the pylon.

11. Turntable according to claim 10, wherein the lower support comprises a number of support shoes connected to and detachable from the bearing journal, and resting upon an inner perimeter surface of the bearing journal, with at least one support shoe closest to the dividing plane of the bearing journal being structured and arranged to grip the bearing journal, and be positioned on and removable from the bearing journal in an axial direction of the pylon.

12. Turntable according to claim 11, wherein support shoes each comprise a back surface structured and arranged to rest flat upon an interior periphery of the bearing journal, and flange bridges standing away at right angles from the back surface and structured and arranged to grip the bearing journal on both sides thereof, wherein the flange bridges, at least on one axial side of the support shoes, are structured and arranged to be detachable from the support shoes.

13. Turntable according to claim 10, wherein one half of the bearing journal comprises front flange plates structured and arranged to be bolted to said side pillars of the support frame.

14. Turntable according to claim 1, wherein said upper support is structured and arranged to both radially and axially support the turntable upon the pylon, and said support frame is structured and arranged to be lowered from an upper end of the pylon onto said lower support.

15. Turntable according to claim 1, wherein said lower support is structured and arranged to solely radially support the turntable upon the pylon.

16. Method for suspending a turntable of a rotary crane upon an anchored pylon, comprising the steps of providing a support frame for the turntable in the form of two supports, namely an upper support and a lower support, moving said support frame with said upper and lower supports into position upon the pylon such that the support frame is initially suspended on top of the pylon by the upper support therefor, and then radially guiding the lower support of the support frame onto the pylon and securing the same to the pylon.

17. The method of claim 16, wherein the turntable with said support therefor is raised only sufficiently high to permit said support to be slid over said upper support suspended thereon.

18. Turntable according to claim 17, additionally comprising rotating gear drives for rotating the turntable on the pylon, being provided on the support frame and resting on a part of the bearing journal that is permanently connected to the side pillars of the lower support.

19. The method of claim 16, wherein said lower support comprises a bearing journal that is radially positioned against the pylon, and comprising the additional step of pushing support shoes from above between the pylon and bearing journal and bolting the support shoe to the bearing journal, to thereby secure said lower support to the pylon.

20. The method of claim 16, comprising the additional steps of moving said lower support to be radially and axially positioned against the pylon, and lowering the support frame from an upper end of the pylon onto the lower support to be radially positioned against the pylon.

* * * * *